US006124066A

United States Patent [19]

Kim et al.

[11] Patent Number: 6,124,066

[45] Date of Patent: Sep. 26, 2000

[54] CARRIER FOR ELECTROPHOTOGRAPHY, AN ELECTROSTATIC LATENT IMAGE DEVELOPER AND AN IMAGE FORMING METHOD

[75] Inventors: Suk Kim; Yasuo Yamamoto; Kazuhiko Yanagida, all of Minami-Ashigara, Japan

[73] Assignee: Fuji Xerox Co., Ltd., Tokyo, Japan

[ * ] Notice: This patent is subject to a terminal disclaimer.

[21] Appl. No.: 08/993,666

[22] Filed: Dec. 18, 1997

[30] Foreign Application Priority Data

| | | | |
|---|---|---|---|
| Dec. 24, 1996 | [JP] | Japan | 8-344143 |
| Feb. 25, 1997 | [JP] | Japan | 9-040991 |
| May 6, 1997 | [JP] | Japan | 9-115914 |

[51] Int. Cl.[7] ..... G03G 9/113

[52] U.S. Cl. ..... 430/106.6; 430/108; 430/111; 430/122

[58] Field of Search ..... 430/106.6, 108, 430/111, 122

[56] References Cited

U.S. PATENT DOCUMENTS

| | | | |
|---|---|---|---|
| 5,391,451 | 2/1995 | Yoshie et al. | 430/106.6 |
| 5,576,133 | 11/1996 | Baba et al. | 430/106.6 |
| 5,654,120 | 8/1997 | Hakata et al. | 430/106.6 |
| 5,683,844 | 11/1997 | Mammino | 430/106.6 |
| 5,686,182 | 11/1997 | Maniar | 428/404 |
| 5,853,877 | 12/1998 | Shibuta et al. | 478/357 |
| 5,932,387 | 8/1999 | Yamamoto et al. | 430/108 |

FOREIGN PATENT DOCUMENTS

| | | | |
|---|---|---|---|
| 61-107257 | 5/1986 | Japan | G03G 9/14 |
| 61-130959 | 6/1986 | Japan | G03G 9/10 |
| 6-161157 | 6/1994 | Japan | G03G 9/113 |
| 7-120086 | 12/1995 | Japan | G03G 9/113 |

*Primary Examiner*—Mark Chapman
*Attorney, Agent, or Firm*—Oliff & Berridge, PLC

[57] ABSTRACT

A carrier for electrophotography having a resin coating layer containing a conductive powder having an aspect ratio of not less than 3 on the core material, in which the dynamic electric resistance of the core material in a magnetic brush state under an electric field of $10^4$ V/cm is not higher than 1 Ω.cm, and the electric resistance of the resin coating layer is within a range of from 10 to $1\times10^8$ Ω.cm, and a developer for an electrostatic latent image using the carrier. An image forming method on which the developing process includes using the above-mentioned developer for an electrostatic latent image, whose development curve, expressed by a contrast potential and the developing toner quantity, has a saturation area, and applying the developing bias to the developer carrying member so that the developing toner quantity shows the saturation characteristic.

19 Claims, 9 Drawing Sheets

CARRIER FOR ELECTROPHOTOGRAPHY, AN ELECTROSTATIC LATENT IMAGE DEVELOPER AND AN IMAGE FORMING METHOD

BACKGROUND OF THE INVENTION

1. Field of the Invention

The present invention relates to a carrier for the electrostatic latent image developers, an electrostatic latent image developer and an image forming method used for developing an electrostatic latent image formed by electrophotography and electrostatic recording methods and the like.

Furthermore, the present invention relates to an image forming method executed by a image forming apparatus such as a digital printer, a digital copying machine and the like which handles an image as a digital signal.

2. Description of the Related Art

The methods to visualize the image information via the electrostatic latent image, such as electrophotography, have been utilized in various fields. In electrophotography, an electrostatic latent image is formed on a photosensitive material in the charging and the light exposure processes, and the electrostatic latent image is developed by a developer containing a toner, and visualized through the transfer and the fixing processes.

On the other hand, in the digital image forming apparatus, binary information of ON/OFF is given as two-dimensional information of predetermined place on the photosensitive material based on the character and image data. When a halftone image is recorded by using such method, an area modulation method using a halftone dot structure and multiple line structure has been conventionally adopted in various printers and copying machines of the digital electrophotographic method, since the algorithm is relatively simple and of low cost.

Furthermore, in the image forming apparatus which reproduces a multi-tone image by using the electrophotographic method, in particular, in a color image forming apparatus, there are two-component developers comprising a toner and a carrier, and one-component developers using a magnetic toner or the like singly, as the developer. The two-component developer has been widely used since the carrier fulfills the functions of stirring, transferring and charging of the developer, thus functions are separated in the developer, and stable charging characteristics and good controllability can be obtained.

Furthermore, as the developing method, a cascade method had been used before, but recently a magnetic brush method which uses a magnetic roll as a developer transfer carrying member has become the mainstream. As the two-component magnetic brush development method, a conductive magnetic brush (CMB) development method using a conductive carrier and an insulating magnetic brush (IMB) development method using an insulating carrier are known.

The IMB development is characterized by the relationship between the latent image potential and the image density on the photosensitive material is linear and the gradient is small, but on the other hand, the solid portion is not sufficiently filled and the edge effect is large. On the other hand, the CMB development has characteristics that it does not have the edge effect and the solid portion is sufficiently filled, in contrast to the insulating magnetic brush developing method, but the relationship between the latent image potential and the image density is abrupt and the gradient is large, and has such defects that carrier-over (migration of the carrier toward the photosensitive material) and brush marks due to the break of the latent image caused by a bias leak are easily caused.

These problems do not have much influence on visual image quality, when black and white images are formed by using only a black toner, and if the degree of the defects is soft. When color images are formed by superposing color toners, however, these problems will become fatal defects. In the black and white images, the above problems are caught only as a microscopic change in density, while in the color images, the above problems are caught as a microscopic change in hue, and noises having different colors will exist in the gradation image. Accordingly, the above problems have an extremely bad effect on the quality of the visual image, particularly of a color image.

There have been disclosed some methods to improve these points and obtain a conductive magnetic brush in which the edge effect is small, and carrier-over and brush marks are hardly caused.

For example, in Japanese Patent Application Publication (JP-B) No. 7-120,086, there is disclosed a carrier in which a core material having a relatively low electric resistance (hereinafter referred to as a "carrier core", or simply a "core") is coated with a resin having high resistance, thereby the electric resistance abruptly changes in some electric field, and it has high resistance in a low electric field, and low resistance in a high electric field. According to the disclosure thereof, since the latent image portion has a high electric field and the non-latent image portion has a low electric field, an excellent solid black printing can be obtained while carrier-over in the non-latent image portion is not caused. In this invention (according to the description in the examples and effects in the publication Japanese Patent Application Publication (JP-B) No. 7-120,086), however, it is presumed that the film thickness of the resin coating layer is considerably thin, and cores having low resistance are exposed partially. Hence, it is considered that the resistance is low in the high electric field due to this structure. Actually, as in the Comparative Examples described later, the electric resistance of a carrier whose core material is coated completely with a resin coating layer having a thick film thickness is high even in a high electric field, and a good solid image could not be obtained. With the partially coated carrier described above in which a part of the core material having low resistance is exposed, the electric charge moves easily via the exposed face, hence brush marks are easily caused in the latent image portion.

Furthermore, in Japanese Patent Application Laid-Open (JP-A) Nos. 61-107,257 and 61-130,959, there is disclosed a ferrite having relatively low electric resistance and having unevenness based on the primary particles on the surface. According to the disclosure thereof, the leak between electric charges having different polarity is suppressed, and brush marks are prevented because of the ferrite having such a minute unevenness. However, since it has a minute unevenness on the carrier surface, the contact area with the toner increases, resulting in a problem that the toner easily adheres, and its charge-imparting ability as a carrier is deteriorated with the lapse of time.

Furthermore, in Japanese Patent Application Laid-open (JP-A) No. 6-161,157, there is described a carrier defined by a ratio of the current value of the carrier core and the current value of the whole carrier coated with a resin, and hence the resolution, density of the solid image and the fine line reproducibility can all be satisfied at the same time. However, sufficient effect is not found in the prevention of the image defects in color images, in particular.

In addition, there is found no report in either example described above that the stability against the environmental changes is improved.

As described above, with regard to the CMB development, the improvement is not sufficient from the standpoint of the recent demand for the high image quality, including color images.

SUMMARY OF THE INVENTION

The object of the present invention, therefore, is to provide a carrier which does not cause image defects such as brush marks, carrier-over or the like, but can obtain good solid images, and has high stability against the environmental changes as well as durability, in images obtained by the electrostatic latent image development method, in particular color images and a developer and an image forming method using the carrier.

Furthermore, in view of the above conventional drawbacks, it is an object of the present invention to provide an image forming method and an image forming apparatus in which even if the sensitivity of the photosensitive material is uneven and there are environmental changes, the quantity of the developing toner migrating toward the latent image is stable, the solid portions are sufficiently filled, and the edge effect, brush marks and carrier-over can be prevented.

The present inventors have investigated with a view to attain the above-mentioned objects, and have found that in order to obtain good solid images by preventing image defects such as brush marks, carrier-over and the like, it is necessary that the electric resistance of the carrier is within a predetermined range, therefore it is important that the electric resistance of the carrier core is lower than the predetermined value and the electric resistance of the resin coating layer is within a predetermined range, and that the stability against the environmental changes is improved by using an acicular conductive powder as the conductive powder contained in the resin coating layer. Thus, the present inventors completed the present invention.

Furthermore, the present inventors have investigated with a view to solving the above-mentioned problems, and found that the shape and the content of the conductive powder affected the stability against environmental changes and deterioration with time, and when a acicular conductive powder is used, excellent stability against environmental changes can be obtained.

Furthermore, it has been found that it is effective for stabilizing the developing toner quantity to use a developing agent in which the development curve, expressed by a contrast potential defined by the development bias potential and the potential of the exposed portion of the latent image carrying member, and by the quantity of the developing toner migrating toward the latent image on the latent image carrier, has a saturation area, and that even if the electric resistance of the resin-coated carrier per se is the same, there is a difference in the saturation characteristics depending upon the electric resistance of the core material, leading to the completion of the present invention.

That is, it is the object of the present invention to provide a carrier for an electrostatic latent image developer for electrophotography having a resin coating layer containing a conductive powder on the core material, wherein the aspect ratio of the conductive powder is not less than 3, the dynamic electric resistance of the core material in a magnetic brush state under an electric field of $10^4$ V/cm is lower than 1 Ω.cm, and the electric resistance of the resin coating layer is within a range of from 10 to $1\times10^8$ Ω.cm.

It is another object of the present invention to provide an electrostatic latent image developer comprising toner particles comprising a binder resin and a coloring agent, and a carrier having a resin coating layer provided on the core material, wherein the carrier has a resin coating layer containing a conductive powder having an aspect ratio of not less than 3, and having an electric resistance in a range of from 10 to $1\times10^8$ Ω.cm, the resin coating layer coated on the core material in a magnetic brush state having a dynamic electric resistance under an electric field of $10^4$ V/cm of less than 1 Ω.cm.

An image forming method comprising the steps of: forming a latent image on a latent image carrying member, developing said latent image by using a developer, transferring the developed toner image to an image receiving member, and thermally fixing the toner image on the image receiving member, wherein said method uses an electrostatic latent image developer comprising:

toner particles comprising a binder resin and a coloring agent, and a carrier having a resin coating layer provided on the core material, said resin coating layer containing a conductive powder which has an aspect ratio of not less than 3 and has an electric resistance in a range of from 10 to $1\times10^8$ Ω.cm, said core material having a dynamic electric resistance of less than 1 Ω.cm under an electric field of $10^4$ V/cm in a magnetic brush state.

DESCRIPTION OF THE PREFERRED EMBODIMENTS

Figure 1:
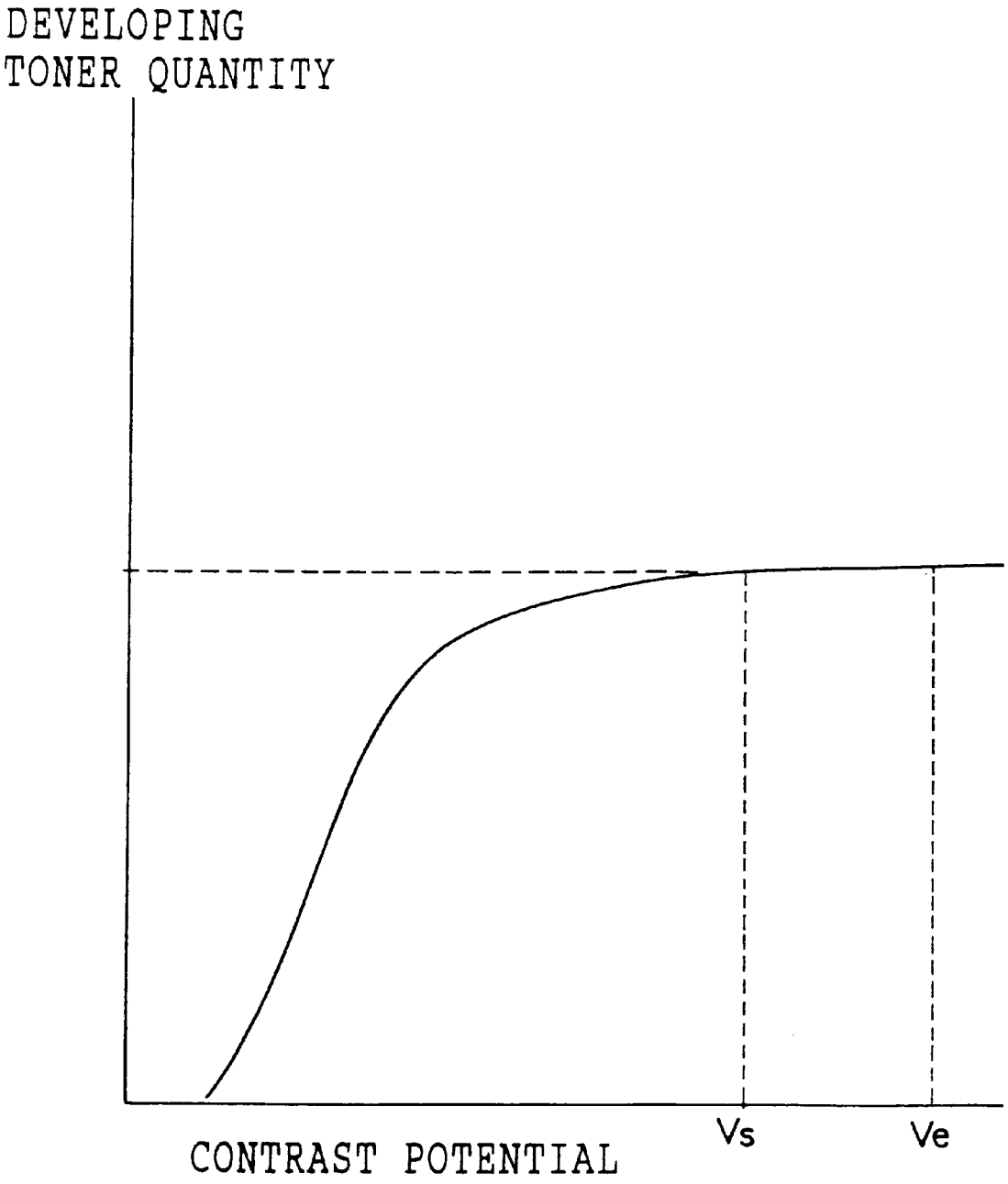
FIG. 1 shows a development curve expressed by a contrast potential and the quantity of the developing toner, and the development curve has a saturation area.

The present invention will now be described with reference to preferred embodiments.

The carrier for an electrostatic latent image developer of the present invention (hereinafter simply referred to as a "carrier") has a resin coating layer having a mean resistance of from 10 to $1\times10^8$ Ω.cm formed on a core having low resistance of not higher than 1 Ω.cm. With such a structure, the quality of solid images and prevention of image defects such as brush marks, carrier-over or the like can be obtained concomitantly. The reason thereof is presumed as follows. In general, when a conductive body is placed in an electric field, the charge is rearranged along the electric field, and a so-called polarization is caused. The speed of the polarization has a relation with the electric resistance of the conductive body, and as the electric resistance becomes low, the speed of the polarization becomes fast. It is considered that such a phenomenon also occurs inside of the core of the carrier placed between the developing roll and the photosensitive material, and that if the electric resistance of the core is low enough to complete the poralization of the core for about $10^{-3}$ seconds when the development is carried out, a development electrode effect due to the polarization of the core itself is added to the charge injection from the developing roll, and, as a result, good solid images can be obtained. However, even if the electric resistance of the core is low, if the electric resistance of the resin coating layer is high, the overall electric resistance becomes high, and good solid images cannot be obtained. On the other hand, since the charge injected from the developing roll flows mainly on the carrier surface, if the electric resistance of the resin coating layer is too low, brush marks and carrier-over are easily caused. Therefore, it is considered that the range of the electric resistance of the core and the resin coating layer fulfilling these conditions are in the above-mentioned range.

As a carrier core used in the present invention, any of the conventionally known carrier cores can be used, but particularly preferably, ferrite having low resistance is selected. As other carrier cores, iron powder, magnetite and the like are known. In the case of iron powder, a toner and an externally additive easily adhere to it due to its large specific gravity, hence iron powder has poorer stability than ferrite. In the case of magnetite, it has problems in that it is difficult to control the resistance and the latitude of the electric resistance is narrow. On the other hand, ferrite can gain low resistance by reduction in a hydrogen current at a certain temperature after baking, and ferrite having various electric resistances can be obtained by controlling the amount of hydrogen ventilation, temperature, the reduction time and the like, hence ferrite is particularly preferable.

The carrier core used in the present invention has a dynamic electric resistance which as measured in a form of a magnetic brush in an electric field of $10^4$ V/cm, is lower than 1 Ω.cm. If the electric resistance of the core material exceeds 1 Ω.cm, the electric resistance of the whole carrier has to be made low in order to obtain a saturation area of the amount developing toner, and brush marks due to the bias leak and carrier-over will be easily caused, hence it is not preferable.

Here, the saturation area means an area where, as shown in FIG. 1, in a development curve expressed by a contrast potential defined by the development bias potential and the potential of the exposed portion of the latent image carrying member, and the quantity of the developing toner migrating toward the latent image on the latent image carrying member, the developing toner quantity migrating to the latent image reaches the limit when the contrast potential becomes higher than a predetermined value and the developing toner quantity is hardly changed by the change of the contrast potential.

In addition, the electric field of $10^4$ V/cm is close to the developing electric field in an actual apparatus, and the above-mentioned electric resistance is defined by a value under this electric field. The dynamic electric resistance of the carrier core is determined by the following manner. A plate electrode having an area of 3 $cm^2$ is placed opposite a developing roll having a diameter of 4 cm and a length in the axial direction of 10 cm with an interval of 2.5 mm, and a carrier core of about 30 $cm^3$ is placed on the developing roll opposite to the plate electrode to form a magnetic brush. Voltage is applied between the developing roll and the plate electrode while rotating the developing roll at a rotation speed of 120 rpm, and the electric current flowing at that time is measured. The electric resistance is determined from the obtained current-voltage characteristics by using an expression of Ohm's law. Incidentally, it is well known that, in general, there is a relationship of log J E½ between the applied electric field E and the current density J at this time (for example, Japanese Journal of Applied Physics, Vol. 19, No. 12, p 2412~). When the electric resistance is considerably low as in the carrier core used in the present invention, sometimes measurement becomes impossible because high current flows in the high electric field of $10^3$ V/cm or higher. In such a case, measurement is performed at three points or more in the low electric field, and the electric resistance is determined by the extrapolation up to the electric field of $10^4$ V/cm by means of the least square method by using the above-mentioned relational expression.

The average particle diameter of the carrier core is preferably from 10 to 100 μm, more preferably, from 20 to 80 μm. If the average particle diameter is smaller than 10 μm, scattering of the developer from the developing apparatus is easily caused, and if the average particle diameter is larger than 100 μm, it is difficult to obtain sufficient image density.

As the resin coating formed on the core, there can be mentioned polyolefin resins, such as polyethylene, polypropylene; polyvinyl and polyvinylidene resins, such as polystyrene, acrylic resin, polyacrylonitrile, polyvinyl acetate, polyvinyl alcohol, polyvinyl butyral, polyvinyl chloride, polyvinyl carbazole, polyvinyl ether, and polyvinyl ketone; vinyl chloride/vinyl acetate copolymer; styrene/acrylic acid copolymer, straight silicone resin comprising organosiloxane bond or modified products thereof; fluorine resins, such as polytetrafluoroethylene, polyvinyl fluoride, polyvinylidene fluoride, polychlorotrifluoroethylene; polyester; polyurethane; polycarbonate; amino resins, such as urea-formaldehyde resin; and epoxy resins. These resins may be used singly, or in a combination of two or more of them.

The thickness of the resin coating layer is preferably from 0.3 to 5 μm, more preferably, from 0.5 to 3 μm. If the thickness of the resin coating layer is less than 0.3 μm, it is difficult to form a uniform resin coating layer on the core surface, in particular, when a core having low resistance is used as in the present invention, migration of charges via the exposed face is caused, and image defects are easily caused. In addition, if the thickness of the resin coating layer is larger than 5 μm, granulation between carriers are caused, and a uniform carrier is not obtained.

As the conductive powder added to the resin coating layer in the present invention, the one having an acicular form is used. "Acicular" powder means a powder having a ratio of the long axis (fiber length) to the short axis (fiber diameter) (long axis/short axis; hereinafter referred to as "aspect ratio") of not less than 3, preferably not less than 5, more preferably not less than 10. The acicular conductive powder easily forms a continuous conductive passage in the resin coating layer, therefore the added amount thereof can be less than of the conductive powder having a spherical shape. Many conductive powders have a hydroxyl group present on the surface and sometimes are porous, hence water is easily adsorbed, and when the added amount thereof is large, the electric resistance and the charging properties of the carrier oscillate a great deal due to the fluctuations in humidity, resulting in various problems. Therefore, by reducing the added amount of the conductive powder, it is possible to improve the stability against the fluctuations in humidity. When the conductive powder is dispersed and mixed in the resin coating, there is a possibility that the conductive powder is cut in the direction of the fiber length, and the aspect ratio is decreased. Therefore, as the conductive powder, preferably the one having the aspect ratio as high as possible is used, and the one having the aspect ratio within the above-mentioned range and imparting a desired electric resistance to the resin coating layer even when the conductive powder is cut may be used without problem.

The acicular conductive powder has preferably a long axis of from 0.1 to 20 $\mu$m. Even if the aspect ratio is not less than 3, if the long axis is shorter than 0.1 $\mu$m, the conductive powder is broken during the process to disperse into the resin coating to decrease the effect. On the other hand, if the long axis is longer than 20 $\mu$m, the rate at which the conductive powder protrudes from the resin coating layer surface increases, hence migration of charges is caused and image defects are easily caused. The short axis of the conductive powder is preferably from 0.01 to 1 $\mu$m. If the short axis is without this range, the dispersibility is deteriorated, and the properties of the carrier become uneven. As the added amount of the conductive powder, it is preferably from 2 to 40% by volume with respect to the resin coating layer, more preferably from 4 to 35% by volume. If the content of the conductive powder is less than 2% by volume, the electric resistance of the resin coating layer does not decrease to the desired value, and if the content of the conductive powder is larger than 40% by volume, the environmental stability is deteriorated.

The electric resistance of the acicular conductive powder is preferably not higher than $1\times10^6$ Ω.cm, respectively. When the electric resistance exceeds $1\times10^6$ Ω.cm, the desired resistance is difficult to obtain in the carrier as a whole.

As the material of the acicular conductive powder, it is not particularly limited so far as it has the desired shape and desired electric resistance, but for example, a complex substance having surfaces of fine particles such as titanium oxide, zinc oxide, aluminum borate, potassium titanate, tin oxide and the like coated with a conductive metal oxide, or a simple substance of a conductive metal oxide are preferable. Here, as the conductive metal oxide, there can be mentioned a metal oxide doped with antimony (for example, antimony doped type tin oxide) and metal oxides of an oxygen deficit type (for example, oxygen deficit type tin oxide).

The electric resistance of the resin coating layer is from 10 to $1\times10^8$ Ω.cm, preferably from $10^3$ to $10^7$ Ω.cm. The electric resistance of the resin coating layer is controlled by kinds, quantity and the like of the conductive powder and the resin coating layer to be used. If the electric resistance of the resin coating layer is smaller than 10 Ω.cm, the charge easily migrates on the carrier surface, resulting in image defects. If the electric resistance of the resin coating layer is larger than $10^8$ Ω.cm, even if a core having low resistance is used, good solid images cannot be obtained. A resin coating film having a thickness of from a fraction of $\mu$m to several $\mu$m is formed on an ITO conductive glass substrate using an applicator, and a gold electrode is formed thereon by vapor deposition to determine the electric resistance of the resin coating layer from the current-voltage characteristics in the electric field of $10^2$ V/cm.

As a method to form a resin coating layer on the carrier core, there can be mentioned an dipping method in which a carrier core is dipped in a solution for forming a resin coating layer, a spray method in which a solution for forming a resin coating layer is sprayed on the carrier core surface, a fluid bed method in which a solution for forming a resin coating layer is sprayed to the carrier core suspended by an air flow, and a kneader coater method in which a carrier core and a solution for forming a resin coating layer are mixed in a kneader coater and the solvent is removed.

The solvent used for the solution for forming a resin coating layer is not particularly limited so far as it dissolves the above-mentioned resin coating, and for example, aromatic hydrocarbons such as toluene, xylene and the like, ketones such as acetone, methyl ethyl ketone and the like, and ethers such as tetrahydrofuran, dioxane and the like can be used. Furthermore, a sand mill, dino mill, homomixer or the like can be used for the dispersion of the conductive powder.

As a preferable range of the dynamic electric resistance when a carrier provided with a resin coat on its surface is measured in a form of a magnetic brush, it is from 10 to $1\times10^9$ Ω.cm, more preferably from $1\times10^3$ Ω.cm to $1\times10^9$ Ω.cm in the electric field of $10^4$ V/cm. If the above-mentioned electric resistance is smaller than 10 Ω.cm, image defects are easily caused, and if it is larger than $10^9$ Ω.cm, good solid images are difficult to obtain. In addition, the measurement method of the dynamic electric resistance is similar to that in the carrier core.

The carrier of the present invention is mixed with a toner and used as a two-component developer. Said toner is obtained, according to customary procedures, by melting and kneading a coloring agent and other additives in a binder resin, cooling and pulverizing them and classifying them as required.

As the binder resin of the toner, there can be mentioned homopolymers or copolymers of styrenes such as styrene, chlorostyrene and the like; monoolefins such as ethylene, propylene, butylene, isoprene and the like; vinyl esters such as vinyl acetate, vinyl propionate, vinyl benzoate, vinyl acetate and the like; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate and the like; vinyl ethers such as vinylmethyl ether, vinylethyl ether, vinylbutyl ether and the like; vinyl ketones such as vinylmethyl ketone, vinylhexyl ketone, vinyl isopropenyl ketone and the like. As representative binder resins, there can be mentioned polystyrene, styrene-acrylate copolymer, styrene-methacrylate copolymer, styrene-acrylonitrile copolymer, styrene-butadiene copolymer, styrene-maleic anhydride copolymer, polyethylene and polypropylene. In addition, there can be mentioned polyester, polyurethane, epoxy resin, silicon resin, polyamide, modified rosin, paraffin, and waxes.

As the coloring agents, there can be exemplified as representatives, carbon black, nigrosine, aniline blue, chalcoil blue, chrome yellow, ultramarine blue, DuPont oil red, Quinoline yellow, methylene blue chloride, Phthalocyanine Blue, Malachite green-oxalate, lamp black, Rose Bengal, C. I. Pigment.Red48:1, C. I. Pigment.Red122, C. I. Pigment.Red57:1, C. I. Pigment.Yellow 97, C. I. Pigment.Yellow 12, C. I. Pigment.Blue 15:1, C. I. Pigment.Blue15:3.

The toner may contain known additives such as charge-controlling agents, fixing auxiliaries or the like as required. The average particle diameter of the toner is not larger than 30 $\mu$m, preferably from 4 to 20 $\mu$m.

As the ratio of the toner when a toner and a carrier are mixed to prepare a developer, it is preferably from 0.3 to 30% by weight with respect to the whole developer. Furthermore, silica, alumina, tin oxide, strontium oxide, various resin powders, and other known externally added agents can be mixed in order to improve the flowability of the developer.

The developer thus obtained can be used in an image forming method comprising a process to form a latent image on a latent image carrier, a process to develop the latent image by using a developer, a process to transfer the developed toner image to a image receiving member, and a fixing process to heat and fix the toner image on the image receiving member.

According to the present invention, preferably, in an image forming method having a latent image forming process for forming a latent image on a latent image carrying member charged uniformly based on the image data and a developing process for developing the latent image with a developer supported on a developer carrying member to which a developing bias potential is applied, or in an image forming apparatus having a latent image forming means for forming a latent image on a latent image carrying member charged uniformly based on the image data and developing means for developing the latent image with a developer supported on a developer carrying member to which a developing bias potential is applied by bias applying means, the above-mentioned developer of the present invention is used, and a developing bias voltage is applied to the developer carrying member so that the quantity of the developing toner migrating to the latent image shows saturation characteristics.

Here, saturation characteristic means that the developing toner quantity is hardly changed by the change of the contrast potential defined by the development bias potential applied to the developer carrying member and the potential of the exposed portion of the latent image carrying member.

As shown in FIG. 1, when the contrast potential in which the gradient of the development curve becomes ⅕ or less compared to the gradient at the initial stage of the development is designated as Vs, the development bias potential can be applied to the developer carrying member, so that the value, obtained by subtracting an absolute value |V1| of the average surface potential V1 of the photosensitive materials of the exposed portion when the exposure of the input image area factor is 100%, from the absolute value |V bias| of the development bias potential V bias, becomes larger than |Vs|. Thus, by setting the development bias potential, even if there is a sensitivity difference in the photosensitive material, the developing toner quantity becomes stable and reproduction of good images becomes possible.

Specifically, it is preferred to use the development bias potential in which the alternating-current electric field having a voltage between peaks of from 100 to 500 V, and a frequency of from 400 Hz to 20 kHz, is superposed on the direct-current electric field.

Figure 2:
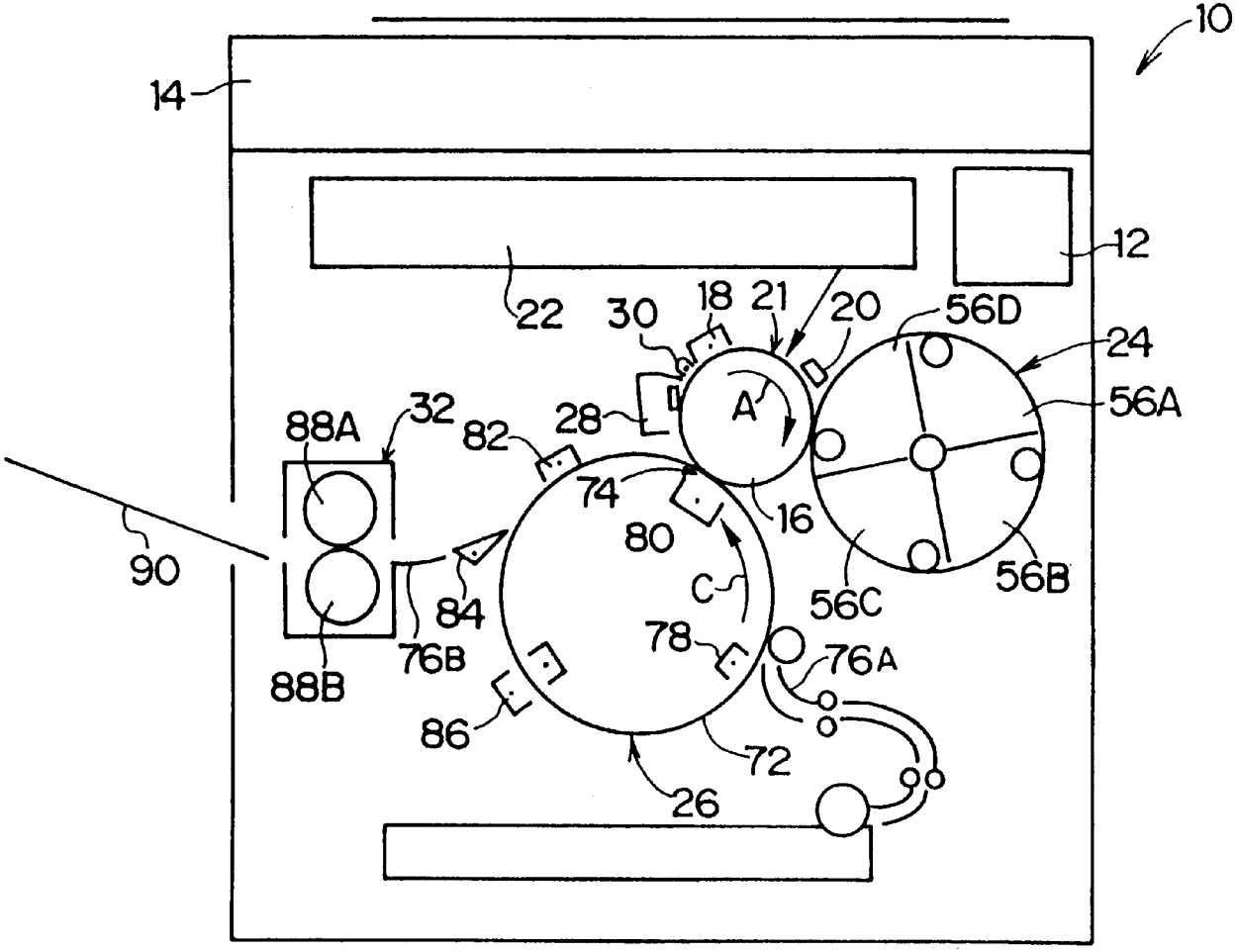
FIG. 2 is a diagram showing the overall structure of the image forming apparatus.

FIG. 2 shows one embodiment of the image forming apparatus to which the present invention is applied.

This image forming apparatus 10 includes a control section 12 for controlling the whole image forming apparatus 10; an original reading section 14 which radiates a light to the original to prepare image signals for each color from the light transmitted through the original or reflected from the original; a photosensitive material 16 as a latent image carrying member rotating in the direction of an arrow A; a charging device 18 arranged in the vicinity of the photosensitive material 16 for uniformly charging the photosensitive material 16; a potential sensor 20 arranged downstream in the rotation direction of the charging device 18 for measuring the potential of the charged photosensitive material 16; a light-beam scanning device (ROS) 22 for scanning and exposing the photosensitive material 16 charged in the exposure section 21 formed upstream of the potential sensor 20 in the rotation direction, based on the image data from the original reading section 14, to form a latent image; a rotary developing device 24 arranged downstream of the exposure section 21 in the rotation direction for transferring a toner to the latent image to form a visible image; a transfer device 26 arranged downstream of the rotary developing device 24 in the rotation direction for transferring the visible image to a recording material; a cleaner 28 arranged downstream of the transfer device 26 in the rotation direction for removing the toner remaining on the photosensitive material 16; a pre-exposure device 30 for exposing the photosensitive material 16 to remove the residual potential; and a fixing device 32 for fixing the visible image on the recording material.

The original reading section 14 includes a light source (not shown) for radiating a light to the original, a color filter (not shown) for separating the light transmitted through or reflected from the original into each color, a photoelectric converter (not shown) for converting the strength of the light for each color into an electric signal which is analog data, an A/D (analog-to-digital) converter (not shown) for converting the electric signal for each color into an image signal for each color which is digital data, and a memory (not shown) for storing the image signal for each color, and the image signal stored in the memory is output to the light-beam scanning device 22 sequentially for each color based on the signal from the control section 12.

Figure 3:
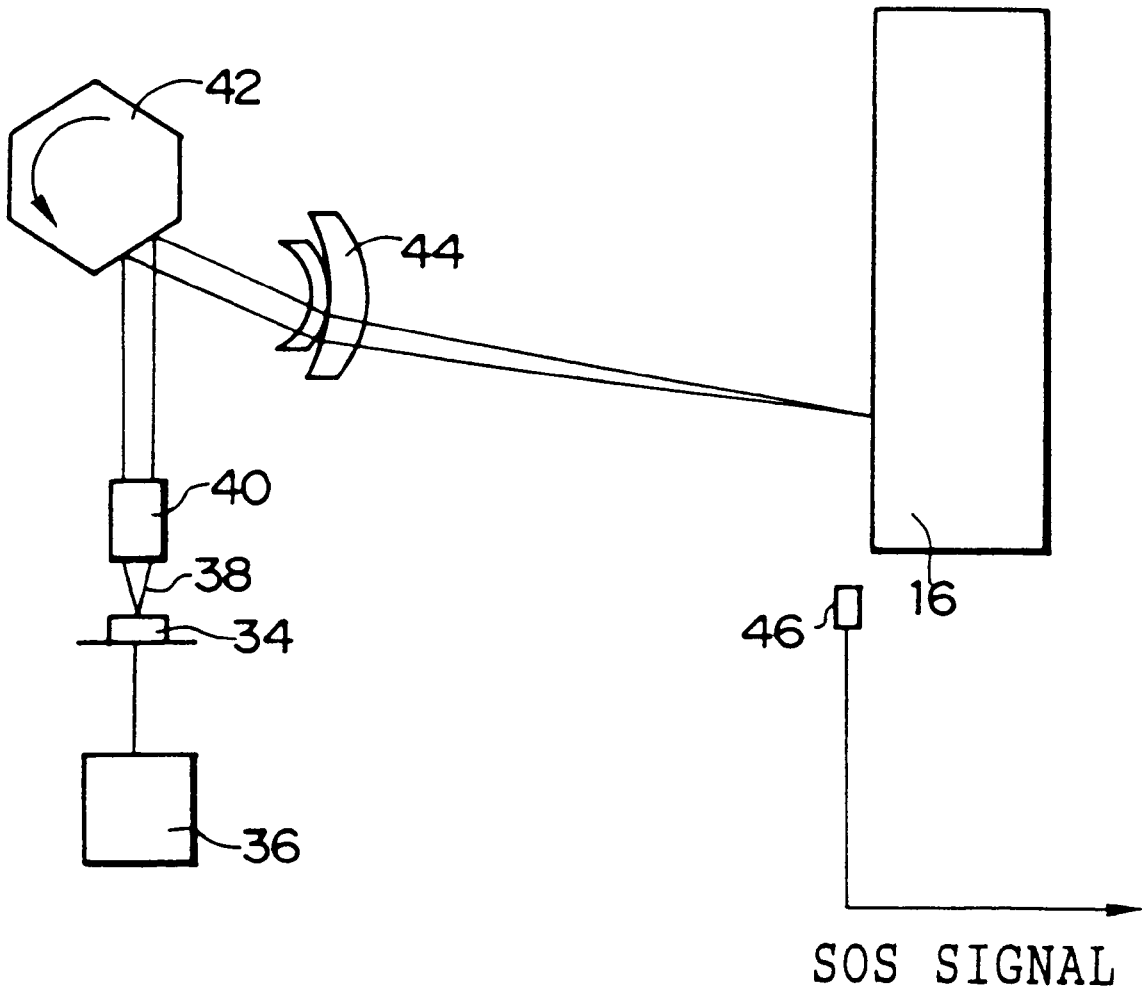
FIG. 3 is a structural diagram of a light-beam scanning device used in the image forming apparatus of FIG. 2.

As shown in FIG. 3, the light-beam scanning device 22 includes a semiconductor laser 34 for radiating the laser beam 38, a pulse-duration modulation device 36 for switching ON/OFF of the semiconductor laser 34 based on the image signal from the original reading section 14, a collimator lens 40 for collimating the laser beam 38 radiated from the semiconductor laser 34 to the parallel beam, apolygon mirror 42 for deflecting the parallel beam from the collimator lens 40 toward the photosensitive material 16 at an equiangular rate, an fθ lens 44 arranged between the polygon mirror 42 and the photosensitive material 16 for forming a beam spot of a predetermined size on the photosensitive material 16, and a sensor 46 for forming a scanning start signal for generating an SOS signal for detecting the light scanning start timing.

Figure 4:
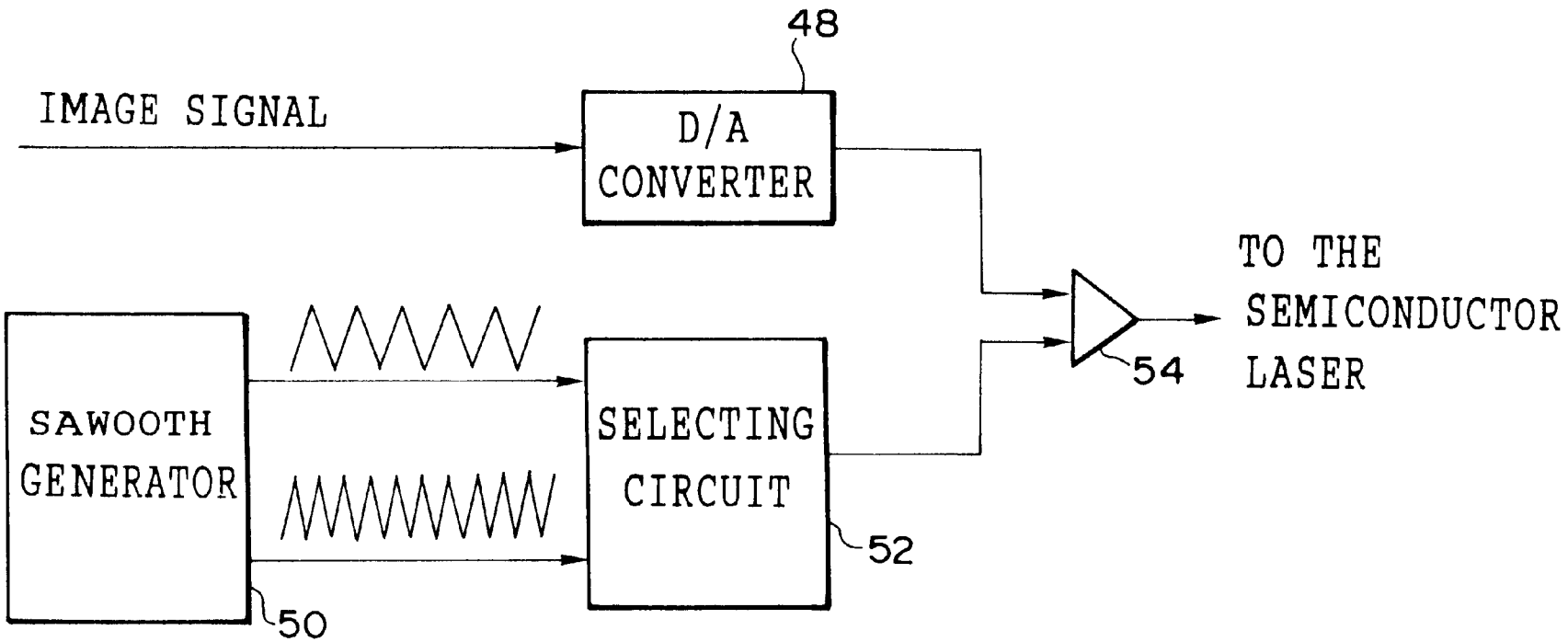
FIG. 4 is a structural diagram of a pulse-width modulation device used in the light-beam scanning device of FIG. 3.

As shown in FIG. 4, the pulse-width modulation device 36 includes a D/A converter 48 for converting the image signal which is digital data from the original reading section 14 into an electric signal which is analog data, a sawtooth generator 50 for forming a number of sawtooth waveforms of different frequency, a waveform selecting circuit 52 for selecting the sawtooth waveform of a desired frequency from a number of sawtooth waveforms formed by the sawtooth generator 50 in response to the resolution, and a comparator circuit 54 for outputting the ON signal for switching the semiconductor laser 34 ON, when the voltage of the sawtooth waveform output from the waveform selecting circuit 52 is higher than the voltage of the electric signal output from the D/A converter 48. And with the above structure, the ON signal having a length in response to the image density of the original is output.

Figure 5:
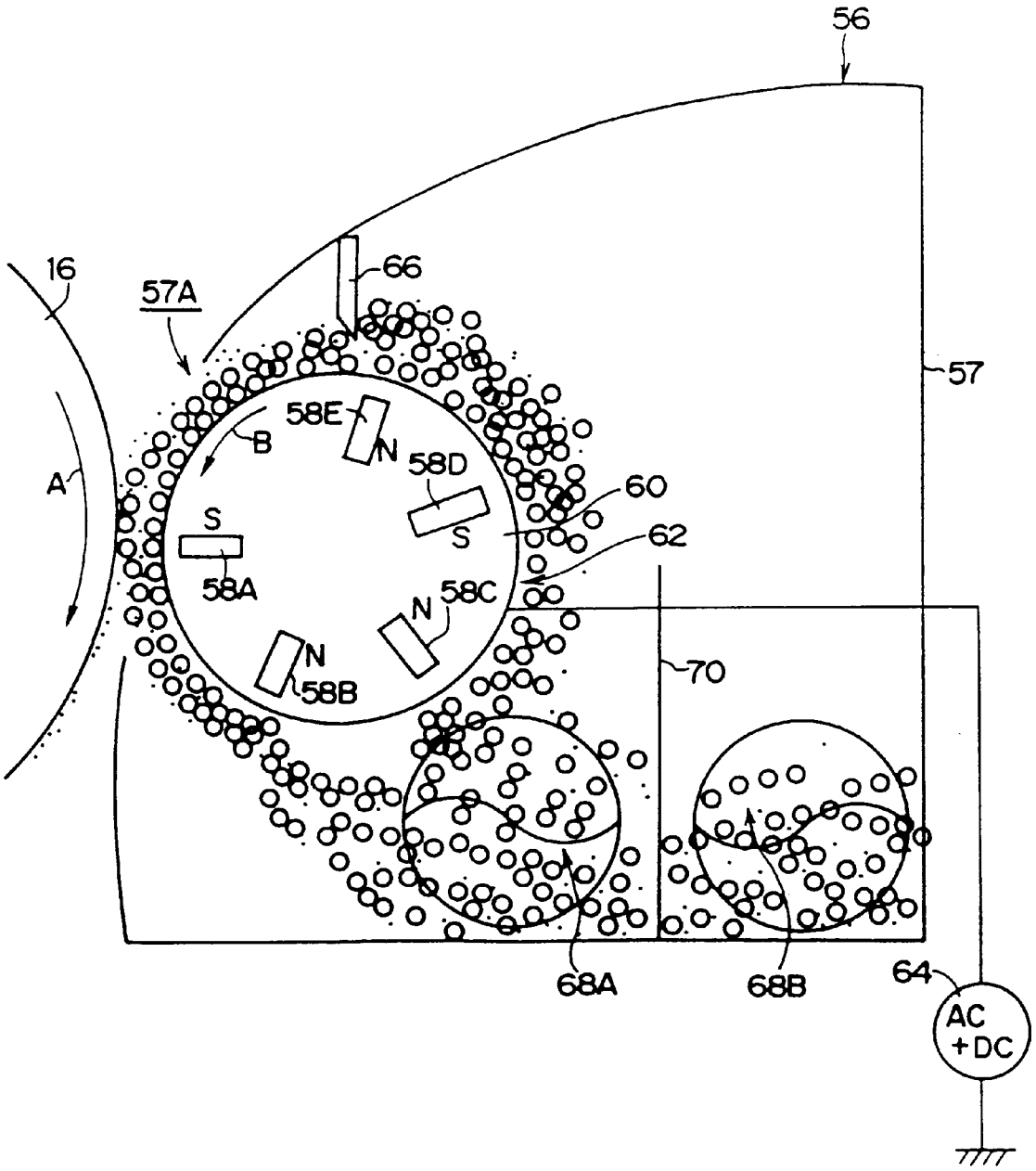
FIG. 5 is a schematic structural diagram of the developing section constituting a rotary developing device used in the image forming apparatus of FIG. 1.

As shown FIG. 2, the rotary developing device 24 is in a cylindrical form, and is composed of 4 inverting development-type and two-component development-type developing sections 56 (56A~56D) for Yellow, Cyan, Magenta, and Black. FIG. 5 shows a schematic diagram of the developing section 56. The developing section 56 includes a developer housing 57 in a fan shape in which an opening 57A is formed along the axial direction on the outer periphery, a magnetic roll 62 comprising a number of fixed magnets 58 (58A~58E) arranged radially and a developing sleeve 60 which rotates in the direction of an arrow B around the fixed magents 58, a bias power feed 64 for feeding direct-current superposed alternating-current bias voltage to the developing sleeve 60 to inhibit the toner from adhering to the white portion, a trimmer bar 66 arranged upstream of the opening section 57A in the rotating direction for making the thickness of the magnetic brush comprising the developer constant, screw augers 68A and 68B arranged downward of the magnetic roll 62 for stirring the developer, a partition wall 70 arranged between screw augers 68A and 68B and provided with an opening (not shown) at the end portion, and a toner feed unit (not shown) for feeding the toner to a certain portion in the screw auger 68B in the development housing 57, in which the magnetic roll 62, screw augers 68A and 68B, trimmer bar 66, toner feed unit and partition wall 70 are housed in the development housing 57.

The magnetic roll 62 is so mounted that the axial direction becomes parallel to the axial direction of the photosensitive material 16, and the rotary developing device 24 is so arranged that when the opening 57A of the development housing 57 of each developing sections 56 (A~D) is arranged at a position opposite to the photosensitive material 16, a predetermined clearance is formed between the magnetic roll 62 included in the development section 56 and the photosensitive material 16.

Furthermore, a number of fixed magnets 58A~E are so arranged that the polarity of the abutting fixed magnets 58B and 58C arranged downstream of the opening 57A in the rotation direction becomes the same, and the polarity of the other abutting fixed magnets 58C and 58D, 58D and 58E, 58E and 58A, and 58A and 58B becomes different. And the magnetic brush adhered to the magnetic roll 62 by the pull of the fixed magnets 58C and 58D arranged on top of the screw auger 68A, is transferred to the opening 57A of the development housing 57 by the pull of the fixed magnets 58D and 58E and fixed magnets 58E and 58A and the rotation of the magnetic roll 62, to rub the photosensitive material 16 (development), as well as the toner remaining on the magnetic roll 62 is removed from the magnetic roll 62 by means of the repulsive force of the fixed magnets 58B and 58C, and falls downward of the development housing 57.

Furthermore, the rotation directions of the screw augers 68A and 68B are made opposite to each other, and the developer is delivered at the opening (not shown) formed at the end of the partition wall 70, thereby the fed toner and the carrier are mixed well to form the developer, which is fed to the magnetic roll 62.

The rotary developing device 24 having the above-mentioned structure is connected to a driving device (not shown) connected to the control section 12, and rotated intermittently based on the signal from the control section 12. Thereby, every time a latent image for each color is formed, the latent image is developed with a toner of the corresponding color.

As shown in FIG. 2, the transfer device 26 includes a transfer drum 72 rotating in the direction of an arrow C. This transfer drum 72 is so arranged that the axial direction thereof is parallel to the axial direction of the photosensitive material 16, and a predetermined clearance is formed between the photosensitive material 16 and the transfer drum 72. In addition, in the periphery of the transfer drum 72, there are arranged a charging device for adsorbing the recording material 78 which is arranged upstream in the rotation direction of the transfer section 74 where the transfer drum 72 is close to the photosensitive material 16, and charges the transfer drum 72 in order to adsorb the recording material transported from the transport passage 76A; a charging device for transfer 80 arranged in the vicinity of the transfer section 74 for transferring the toner image on the photosensitive material 16 to the recording material adsorbed on the transfer drum 72; a charging device for peeling 82 arranged downstream of the transfer-charging device 80 in the rotation direction for charging the transfer drum 72 in order to peel off the adsorbed recording material; a peel-off nail 84 arranged downstream of the charging device for peeling 82 in the rotation direction for peeling off the recording material from the transfer drum 72; and a change eraser 86 arranged downstream of the peel-off nail 84 in the rotation direction for removing the charge remaining on the transfer drum 72.

The fixing device 32 is arranged on the top of the transport passage 76B and downstream of the peel-off nail 84 in the direction of transportaion, and includes a pair of fixing rolls 88A and 88B which put the transport passage 76B between them. At least one of the pair of fixing rolls 88A and 88B is heated by a heater (not shown), and the recording material transported from the transfer device 26 is guided to the nipping portion of the pair of fixing rolls 88A and 88B, and heated by this nipping portion to fix a multi-color image on the recording material.

A tray 90 is provided downstream of the fixing rolls 88A and 88B in the direction of transportation, and the recording material on which an image is fixed is guided to this tray 90 by means of the rotation of the fixing rolls 88A and 88B.

With the above-mentioned image forming apparatus 10, the original is read by the original reading section 14, thereby image signals for each color are formed, and the formed image signals for each color are output sequentially to the light-beam scanning device 22. On the other hand, the photosensitive material 16 is charged, latent images for each color are formed on the photosensitive material 16 by the light-beam scanning device 22, and every time the latent image for each color is formed, the rotary developing device 24 develops the latent image with a toner of the corresponding color. The developed toner image for a particular color is transferred onto the recording material adsorbed by the transfer drum 72. By repeating the above-mentioned formation of latent images, development, and transfer for each color onto one recording material, a multi-color image is formed on the recording material. The recording material on which a multi-color image is formed is transported to the fixing device 32 for fixing, and finally transported to the tray 90.

Incidentally, the latent image formed by the image forming apparatus 10 is put into a binary value, therefore the following description is for the latent image put into a binary value.

Figure 6A:
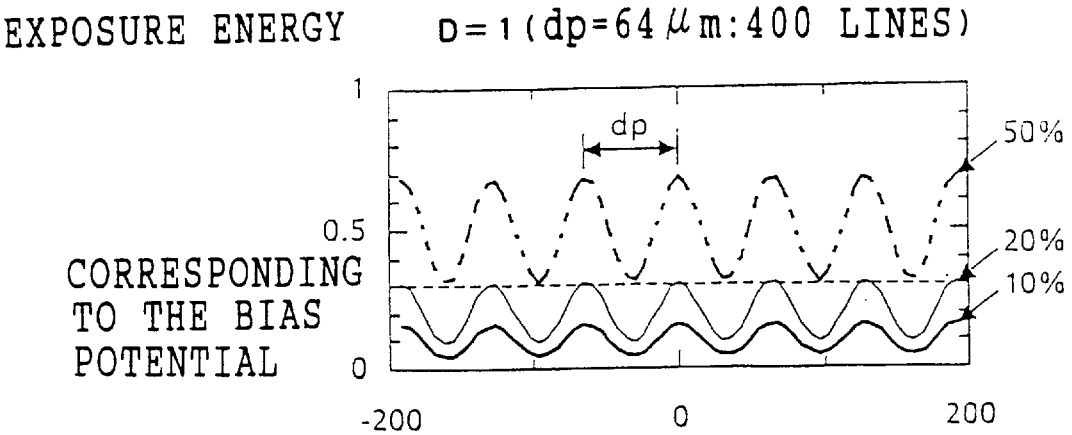
FIGS. 6A, 6B and 6C show exposure energy profile of the photosensitive material.
Figure 6B:
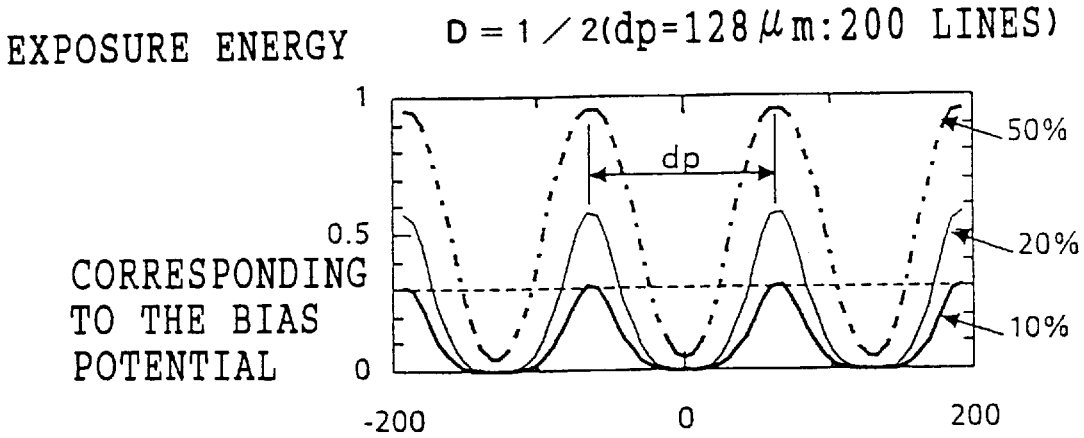
Figure 6C:
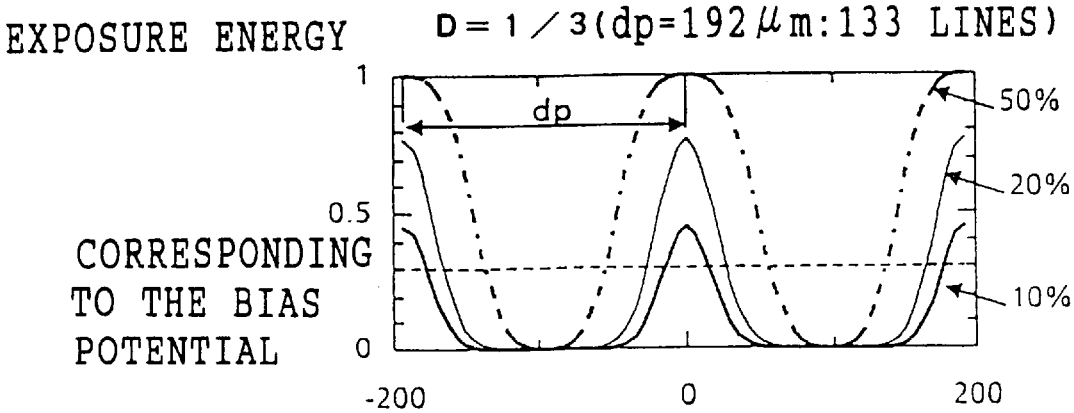
Figure 7:
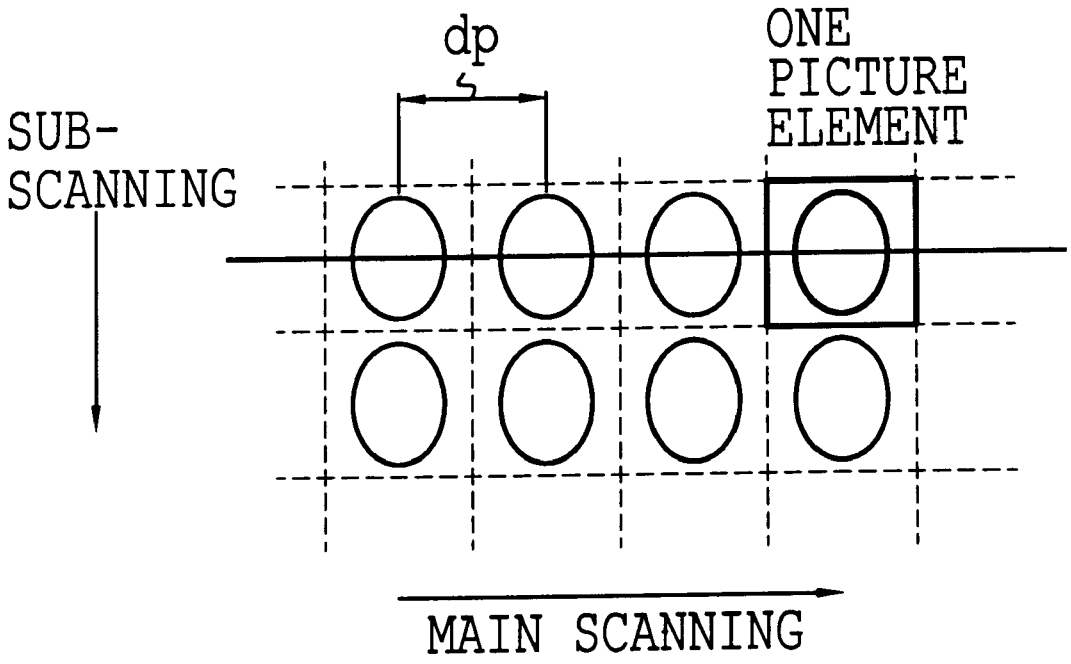
FIG. 7 is a diagram explaining the distance between picture elements.

FIG. 6 shows an exposure energy profile on the photosensitive material when the light-beam spot diameter dB (mm) is made constant, the value of D expressed by a ratio of a distance dP (mm) between picture elements abutting in the scanning direction (see FIG. 7) and a beam spot diameter dB (dB/dP) is designated as 1/1, 1/2 and 1/3, respectively, and a photosensitive material is exposed at an input image area factor of 10%, 20% and 50% by using a light-beam scanning device. As is seen from FIG. 6, as the D value grows from 1/3 through to 1/1, the contrast of the exposure energy profile decreases becoming analogous.

Figure 8A:
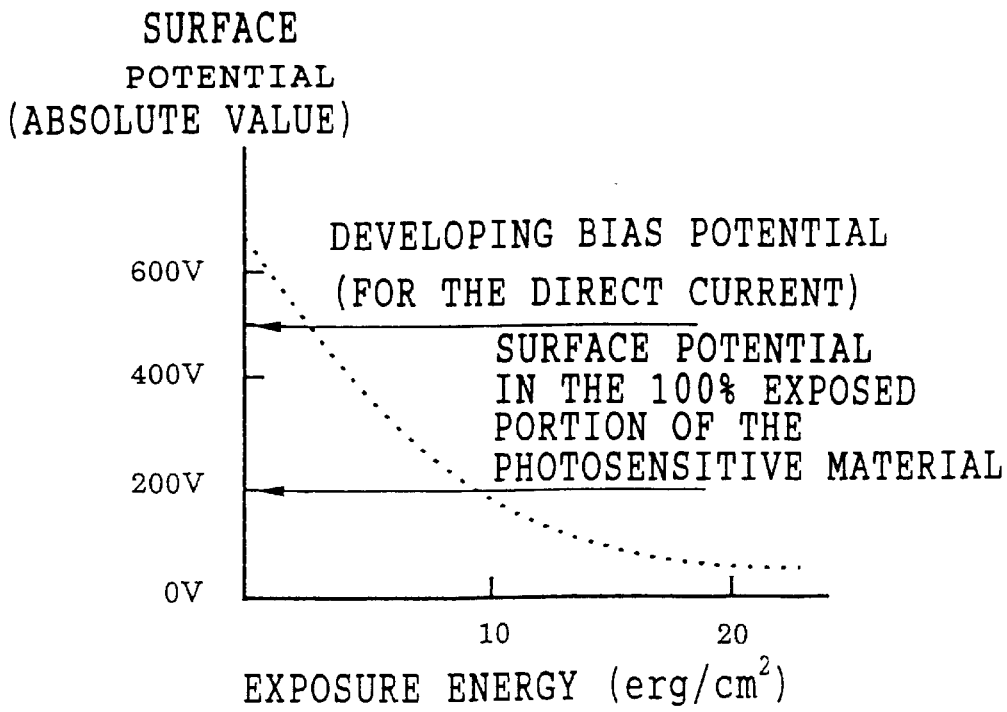
FIGS. 8A and 8B show the light potential attenuation characteristics of the photosensitive material.
Figure 8B:
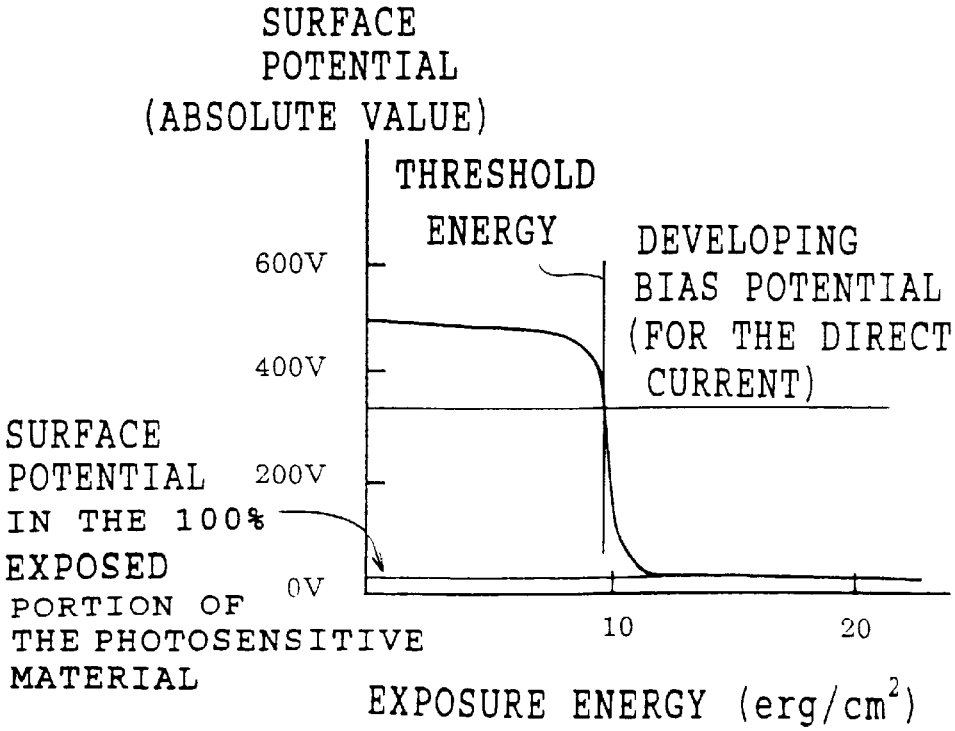
Figure 9A:
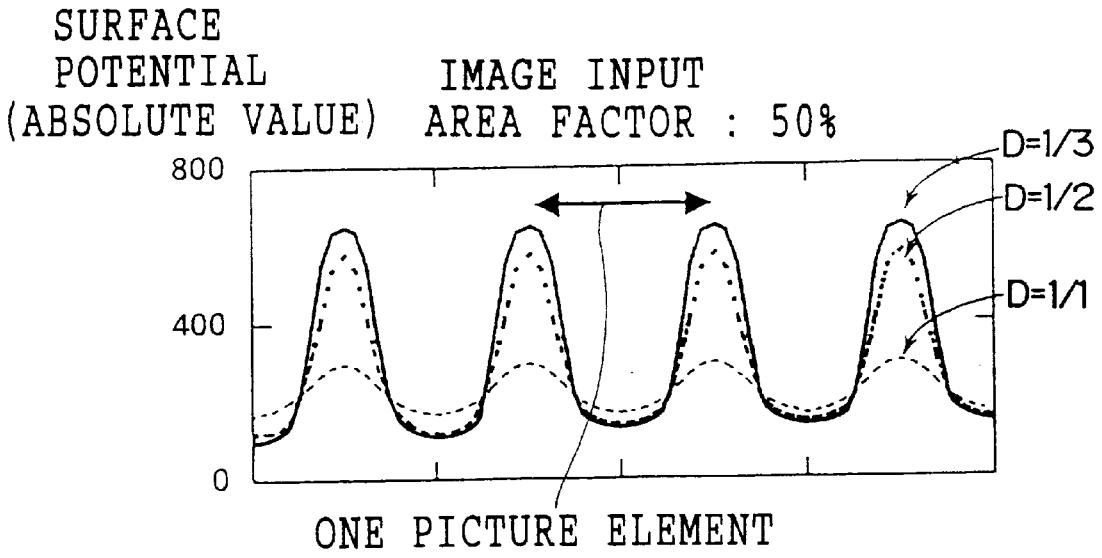
FIGS. 9A and 9B show potential profiles of the photosensitive material put into a binary value.

FIG. 8A and 8B show the light potential damping characteristics of the photosensitive material, and FIG. 9A is a result of the calculation for determining the surface potential profiles of the photosensitive material when a photosensitive material having the light potential damping characteristics shown in FIG. 8A is exposed at an input image area factor of 50%, and the D value is changed in the exposure energy profile as shown in FIG. 6. The calculation method is described in, for example, "Proceedings IS&T's 9th International Congress on Advances in Non-Impact Printing Technologies, Vol. 9", pp. 97~100, published in 1993.

As is seen from FIG. 9A, as the D value becomes larger, the contrast of the exposure energy profile decreases, with the contrast of the surface potential profile of the latent image being decreased.

In this specification, the latent image is in a binary state, which means that the latent image contrast potential $|Va-Vb|$ which is formed by the photosensitive material surface potential Va of the exposed portion (to be exposed originally) and the photosensitive material surface potential Vb of the non-exposed portion (not to be exposed originally), when an exposure at the input image area factor of 50% is performed, is not less than 90% of the latent image contrast potential $|Vh-Vl|$ which is formed by the charging potential Vh of the photosensitive material and the average photosensitive material surface potential Vl of the exposed portion, when an exposure at the input image area factor of 100% is performed.

Therefore, when a photosensitive material having the light potential damping characteristics shown in FIG. 8A is used, the latent image can be put into a binary value by decreasing the D value to less than ½.

Figure 9B:
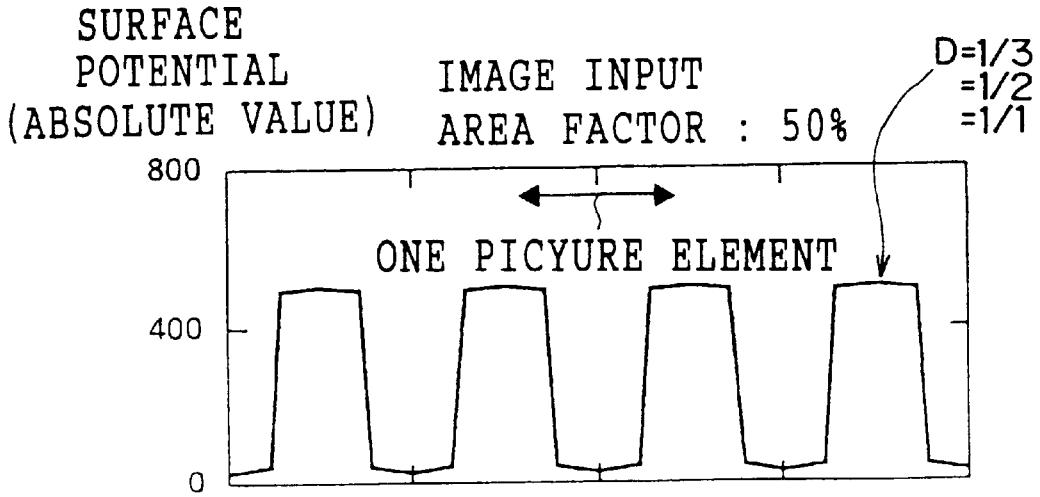

Furthermore, when a photosensitive material having the light potential damping characteristics shown in FIG. 8B is used, the latent image can be put into a binary value by adjusting the exposure energy properly, even if the D value is 1, as shown in FIG. 9B.

EXAMPLES

The present invention will now be described specifically with reference to Examples and Comparative Examples. Incidentally, the measurement of the electric resistance in the Examples and Comparative Examples were all performed in an environment of a temperature of 22° C. and a humidity of 55%.

Preparation of the Carrier

Carrier A (to be used in Examples 1, 7 and 13)

| | |
|---|---|
| Magnetite (MX030A, average particle diameter 50 μm, produced by FDK Corp.) | 100 parts by weight |
| Toluene | 13.5 parts by weight |
| Styrene-methyl methacrylate copolymer (copolymerization ratio 20:80, weight average molecular weight 50,000) | 1.8 parts by weight |
| Potassium titanate coated with antimony doped tin oxide (Dentole BK-100, electric resistance $10^4$ Ω · cm, fiber length 15 μm, fiber diameter 0.3 μm, aspect ratio 50, produced by Otsuka Chemical Co., Ltd.) | 0.9 parts by weight |

The above components except magnetite were dispersed for 1 hour by a sand mill to prepare a solution for forming a resin coating layer. Then, this solution for forming a resin coating layer and magnetite were put into a vacuum degassing type kneader, and stirred for 20 minutes while decompressing at a temperature of 60° C. to form a resin coating layer, thus a carrier A was obtained. The thickness of the resin coating layer was 0.9 μm. Furthermore, the content of the conductive powder was 12% by volume. When this carrier was observed with a scanning electron microscope, it was confirmed that the carrier had no exposed face and was uniformly coated.

In addition, the solution for forming the resin coating layer was coated on an ITO conductive glass substrate so that the thickness thereof became 0.9 μm by using an applicator, to obtain a sample for measuring the electric resistance of the resin coating film.

The electric resistances of the magnetite and the carrier A in a form of a magnetic brush were measured, and the electric resistance values when being extrapolated up to an electric field of $10^4$ V/cm were $4\times10^{-5}$ Ω.cm and $8\times10^7$ Ω.cm, respectively. In addition, the electric resistance value of the resin coating film in an electric field of 100 V/cm was $2\times10^5$ Ω.cm.

Carrier B (to be used in Examples 2 and 8)

| | |
|---|---|
| Ferrite (MF-35, average particle diameter 35 μm, produced by Powdertec Co., Ltd.) | 100 parts by weight |
| Toluene | 22 parts by weight |
| Styrene-methyl methacrylate copolymer (copolymerization ratio 20:80, weight average molecular weight 50,000) | 3 parts by weight |
| Titanium oxide coated with antimony doped tin oxide (FT-2000, electric resistance $10^1$ Ω · cm, fiber length 8 μm, fiber diameter 0.1 μm, aspect ratio 80, produced by Ishihara Sangyo Kaisha, Ltd.) | 1.3 parts by weight |

The above components except ferrite were dispersed for 1 hour by a sand mill to prepare a solution for forming a resin coating layer. Then, this solution for forming a resin coating layer and ferrite were put into a vacuum degassing type kneader, and stirred for 20 minutes while decompressing at a temperature of 60° C. to form a resin coating layer, thus a carrier B was obtained. The thickness of the resin coating layer was 0.9 μm. Furthermore, the content of the conductive powder in the resin coating layer was 8% by volume. When this carrier was observed with a scanning electron microscope, it was confirmed that the carrier had no exposed face and was uniformly coated.

In addition, the solution for forming the resin coating layer was coated on an ITO conductive glass substrate so that the thickness thereof became 0.9 μm by using an applicator, to obtain a sample for measuring the electric resistance of the resin coating film.

The electric resistances of the ferrite and the carrier B in a form of a magnetic brush were measured, and the electric resistance value when being extrapolated up to an electric field of $10^4$ V/cm were $5\times10^{-2}$ Ω.cm and $2\times10^7$ Ω.cm, respectively. In addition, the electric resistance value of the resin coating film in an electric field of 100 V/cm was $1\times10^3$ Ω.cm.

Carrier C (to be used in Examples 3 and 9)

| | |
|---|---|
| Ferrite (C28-FB, average particle diameter 50 μm, produced by FDK Corp.) | 100 parts by weight |
| Toluene | 14 parts by weight |
| Styrene-methyl methacrylate copolymer (copolymerization ratio 20:80, weight average molecular weight 50,000) | 4 parts by weight |
| Aluminum borate coated with antimony doped tin oxide (Pastran 5110S, electric resistance $10^1$ Ω · cm, fiber length 15 μm, fiber diameter 1 μm, aspect ratio 15, produced by Mitsui Mining & Smelting Co., Ltd.) | 0.8 parts by weight |

The above components except ferrite were dispersed for 1 hour by a sand mill to prepare a solution for forming a resin coating layer. Then, this solution for forming a resin coating layer and ferrite were put into a vacuum degassing type kneader, and stirred for 20 minutes while decompressing at a temperature of 60° C. to form a resin coating layer, thus a carrier C was obtained. The thickness of the resin coating layer was 1.8 μm. Furthermore, the content of the conductive powder in the resin coating layer was 5% by volume. When this carrier was observed with a scanning electron microscope, it was confirmed that the carrier had no exposed face and was uniformly coated.

In addition, the solution for forming the resin coating layer was coated on an ITO conductive glass substrate so that the thickness thereof became 1.8 μm by using an applicator, to obtain a sample for measuring the electric resistance of the resin coating film.

The electric resistances of the ferrite and the carrier C in the form of a magnetic brush were measured, and the electric resistance values when being extrapolated up to an electric field of $10^4$ V/cm were $1\times10^{-5}$ Ω.cm and $4\times10^5$ Ω.cm, respectively. In addition, the electric resistance value of the resin coating film in an electric field of 100 V/cm was $8\times10^3$ 106 .cm.

Carrier D (to be used in Examples 4 and 10)

| | |
|---|---|
| Iron powder (TSV, average particle diameter 60 μm, produced by Powdertec Co., Ltd.) | 100 parts by weight |
| Toluene | 8 parts by weight |
| Styrene-methyl methacrylate copolymer (copolymerization ratio 20:80, weight average molecular weight 50,000) | 1 part by weight |
| Potassium titanate coated with antimony doped tin oxide (Dentol BK-100, electric resistance $10^4$ Ω · cm, fiber length 15 μm, fiber diameter 0.3 μm, aspect ratio 50, produced by Otsuka Chemical Co., Ltd.) | 0.3 part by weight |

The above components except iron powder were dispersed for 1 hour by a sand mill to prepare a solution for forming a resin coating layer. Then, this solution for forming a resin coating layer and iron powder were put into a vacuum degassing type kneader, and stirred for 20 minutes while decompressing at a temperature of 60° C. to form a resin coating layer, thus a carrier D was obtained. The thickness of the resin coating layer was 0.9 μm. Furthermore, the content of the conductive powder in the resin coating layer was 8% by volume. When this carrier was observed with a scanning electron microscope, it was confirmed that the carrier had no exposed face and was uniformly coated.

In addition, the solution for forming the resin coating layer was coated on an ITO conductive glass substrate so that the thickness thereof became 0.9 μm by using an applicator, to obtain a sample for measuring the electric resistance of the resin coating film.

The electric resistances of the iron powder and the carrier D in the form of a magnetic brush were measured, and the electric resistance values when being extrapolated up to an electric field of $10^4$ V/cm, were $1\times10^{-14}$ Ω.cm and $2\times10^6$ Ω.cm, respectively. In addition, the electric resistance value of the resin coating film in an electric field of 100 V/cm was $5\times10^6$ Ω.cm.

Carrier E (to be used in Examples 5 and 11)

| | |
|---|---|
| Magnetite (MX030A, average particle diameter 50 μm, produced by FDK Corp.) | 100 parts by weight |
| Toluene | 13.5 parts by weight |
| Styrene-methyl methacrylate copolymer (copolymerization ratio 20:80, weight average molecular weight 50,000) | 1.6 parts by weight |
| Potassium titanate coated with antimony doped tin oxide (Dentol BK-100, electric resistance $10^4$ Ω · cm, fiber length 15 μm, fiber diameter 0.3 μm, aspect ratio 50, produced by Otsuka Chemical Co., Ltd.) | 1.6 parts by weight |

The above components except magnetite were dispersed for 1 hour by a sand mill to prepare a solution for forming a resin coating layer. Then, this solution for forming a resin coating layer and magnetite were put into a vacuum degassing type kneader, and stirred for 20 minutes while decompressing at a temperature of 60° C. to form a resin coating layer, thus a carrier E was obtained. The thickness of the resin coating layer was 0.9 μm. Furthermore, the content of the conductive powder in the resin coating layer was 22% by volume. When this carrier was observed with a scanning electron microscope, it was confirmed that the carrier had no exposed face and was uniformly coated.

In addition, the solution for forming the resin coating layer was coated on an ITO conductive glass substrate so that the thickness thereof became 0.9 μm by using an applicator, to obtain a sample for measuring the electric resistance of the resin coating film.

The electric resistance of the carrier E in the form of a magnetic brush was measured, and the electric resistance value when being extrapolated up to an electric field of $10^4$ V/cm was $1\times10^5$ Ω.cm. In addition, the electric resistance value of the resin coating film in an electric field of 100 V/cm was $2\times10^3$ Ω.cm.

Carrier F (to be used in Comparative Examples 1, 4 and 6)

| | |
|---|---|
| Ferrite (C28-FB, average particle diameter 50 μm, produced by FDK Corp.) | 100 parts by weight |
| Toluene | 14.5 parts by weight |
| Styrene-methyl methacrylate copolymer (copolymerization ratio 20:80, weight average molecular weight 50,000) | 2 parts by weight |

A solution for forming a resin coating layer obtained by dissolving a resin in toluene, and ferrite were put into a vacuum degassing type kneader, and stirred for 20 minutes while decompressing at a temperature of 60° C. to form a resin coating layer, thus a carrier F was obtained. The thickness of the resin coating layer was 0.9 μm. When this carrier was observed with a scanning electron microscope, it was confirmed that the carrier had no exposed face and was uniformly coated.

In addition, the solution for forming the resin coating layer was coated on an ITO conductive glass substrate so that the thickness thereof became 0.9 μm by using an applicator, to obtain a sample for measuring the electric resistance of the resin coating film.

The electric resistance of the carrier F in the form of a magnetic brush was measured, and the value in an electric field of $10^4$ V/cm was $6.3\times10^{10}$ Ω.cm. Furthermore, the value in an electric field of 400 V/cm was $1.0\times10^{11}$ Ω.cm, and the value in an electric field of 4000 V/cm was $9.8\times10^{10}$ Ω.cm. In addition, the electric resistance value of the resin coating film in an electric field of 100 V/cm, was $1\times10^{13}$ Ω.cm. As is seen from this Comparative Example, when a resin having high resistance was uniformly coated on a core having low resistance, abrupt change in the electric resistance due to the electric field was not seen.

Carrier G (to be used in Comparative Example 2)

| | |
|---|---|
| Ferrite (F-300, average particle diameter 50 μm, produced by Powdertec Co., Ltd.) | 100 parts by weight |
| Toluene | 12.3 parts by weight |
| Styrene-methyl methacrylate copolymer (copolymerization ratio 20:80, weight average molecular weight 50,000) | 1.6 parts by weight |
| Titanium oxide coated with antimony doped tin oxide (FT-2000, electric resistance $10^1$ Ω · cm, fiber length 8 μm, fiber diameter 0.1 μm, aspect ratio 80, produced by Ishihara Sangyo Kaisha Ltd.) | 1.9 parts by weight |

The above components except ferrite were dispersed for 1 hour by a sand mill to prepare a solution for forming a resin coating layer. Then, this solution for forming a resin coating layer and ferrite were put into a vacuum degassing type kneader, and stirred for 20 minutes while decompressing at a temperature of 60° C. to form a resin coating layer, thus a carrier G was obtained. The thickness of the resin coating layer was 0.9 μm. Furthermore, the content of the conductive powder in the resin coating layer was 20% by volume. When this carrier was observed with a scanning electron microscope, it was confirmed that the carrier had no exposed face and was uniformly coated.

In addition, the solution for forming the resin coating layer was coated on an ITO conductive glass substrate so that the thickness thereof became 0.9 μm by using an applicator, to obtain a sample for measuring the electric resistance of the resin coating film.

The electric resistance of ferrite and the carrier G in the form of a magnetic brush were measured, and the values in an electric field of $10^4$ V/cm were $9.1\times10^7$ Ω.cm (measured value) and $2\times10^6$ Ω.cm (extrapolated value), respectively. In addition, the electric resistance value of the resin coating film in an electric field of 100 V/cm was 5 Ω.cm.

Carrier H (to be used in Comparative Examples 3 and 5)

| | |
|---|---|
| Ferrite (C28-FB, average particle diameter 50 μm, produced by FDK Corp.) | 100 parts by weight |
| Toluene | 12.6 parts by weight |
| Styrene-methyl methacrylate copolymer (copolymerization ratio 20:80, weight average molecular weight 50,000) | 1.3 parts by weight |
| Barium sulfate coated with oxygen deficit type tin oxide (Pastran 4320, electric resistance $10^2$ Ω · cm, spherical shape, particle diameter 0.1 μm, produced by Mitsui Mining & Smelting Co., Ltd.) | 3.6 parts by weight |

The above components except ferrite were dispersed for 1 hour by a sand mill to prepare a solution for forming a resin coating layer. Then, this solution for forming a resin coating layer and ferrite were put into a vacuum degassing type kneader, and stirred for 20 minutes while decompressing at a temperature of 60° C. to form a resin coating layer, thus a carrier H was obtained. The thickness of the resin coating layer was 0.9 μm. Furthermore, the content of the conductive powder in the resin coating layer was 35% by volume. When this carrier was observed with a scanning electron microscope, it was confirmed that the carrier had no exposed face and was uniformly coated.

In addition, the solution for forming the resin coating layer was coated on an ITO conductive glass substrate so that the thickness thereof became 0.9 μm by using an applicator, to obtain a sample for measuring the electric resistance of the resin coating film.

The electric resistance of the carrier H in the form of a magnetic brush was measured, and the electric resistance value when being extrapolated up to an electric field of $10^4$ V/cm was $2\times10^5$ Ω.cm. In addition, the electric resistance value of the resin coating film in an electric field of 100 V/cm was $1\times10^4$ Ω.cm.

Carrier I (to be used in Comparative Examples 10 and 16)

| | |
|---|---|
| Ferrite (MF-35, average particle diameter 35 μm, produced by Powdertec Co., Ltd.) | 100 parts by weight |
| Toluene | 22 parts by weight |
| Styrene-methyl methacrylate copolymer (copolymerization ratio 20:80, weight average molecular weight 50,000) | 3 parts by weight |
| Titanium oxide coated with oxygen deficit type tin oxide (custom made product, electric resistance $10^1$ Ω · cm, fiber length 8 μm, fiber diameter 0.1 μm, aspect ratio 80, producedby Mitsui Mining & Smelting Co., Ltd.) | 1.3 parts by weight |

The above components except ferrite were dispersed for 1 hour by a sand mill to prepare a solution for forming a resin coating layer. Then, this solution for forming a resin coating layer and ferrite were put into a vacuum degassing type kneader, and stirred for 20 minutes while decompressing at a temperature of 60° C. to form a resin coating layer, thus a carrier I was obtained. The thickness of the resin coating layer was 0.9 μm. Furthermore, the content of the conductive powder in the resin coating layer was 8% by volume. When this carrier was observed with a scanning electron microscope, it was confirmed that the carrier had no exposed face and was uniformly coated.

In addition, the solution for forming the resin coating layer was coated on an ITO conductive glass substrate so that the thickness thereof became 0.9 μm by using an applicator, to obtain a sample for measuring the electric resistance of the resin coating film.

The electric resistances of the ferrite and the carrier I in the form of a magnetic brush were measured, and the electric resistance values when being extrapolated up to an electric field of $10^4$ V/cm were $5\times10^{-2}$ Ω.cm, and $6\times10^7$ Ω.cm, respectively. In addition, the electric resistance value of the resin coating film in an electric field of 100 V/cm was $3\times10^3$ Ω.cm.

Preparation of a Toner Used in Examples 1 to 6 and Comparative Examples 1 to 3

| | |
|---|---|
| Linear polyester resin | 100 parts by weight |

-continued

| | |
|---|---|
| (linear polyester obtained from terephthalic acid/bisphenol A ethylene oxide adduct/ cyclohexanedimethanol; Tg = 62° C., Mn = 4,000, Mw = 12,000, acid value = 12, hydroxyl value = 25) | |
| Magenta pigment (C. I. Pigment, Red 57) | 3 parts by weight |

The above mixture was kneaded in an extruder, and pulverized with a jet mill. Thereafter, the mixture was dispersed with a wind energy classifier to obtain a Magenta toner of d50=7 $\mu$m.

Preparation of a Developer 100 parts by weight of the afore-mentioned carrier A~I were mixed with 8 parts by weight of the above Magenta toner, to prepare developers for Examples 1 to 10 and Comparative Examples 1 to 3.

Evaluation Test

The above developers were subjected to a reproduction test by using an electrophotographic copying machine (produced by Fuji Xerox Co., A-Color 630) and adjusting the evaluation environment to a low temperature and low humidity (10° C., 15%), a normal temperature and normal humidity (22° C., 55%) and a high temperature and high humidity (28° C., 85%), respectively.

Image Density

A solid image (20 mm×20 mm) having an original density of 0.50 was reproduced, and the relative reflection density of the output image with respect to the white paper was measured by a Macbeth densitometer. It was judged that the closer the image density was to 0.50, the better it was. The first copy and the 50,000th copy were evaluated at normal temperature and normal humidity, and the first copy was evaluated under low temperature and low humidity, and high temperature and high humidity.

Density Unevenness

The output image was evaluated by visual inspection, by providing a criteria. ○ indicates that the density is uniform, and X indicates that the density is not uniform. The evaluation was performed for the first copy.

Brush Mark

The number of white marks occurring in the output image was evaluated by a microscope with respect to unit lengths (5 mm) in the brush direction and in the right-angle direction. The first copy was subjected to the evaluation.

Carrier-Over

The output image was evaluated by visual inspection. ○ indicates that no carrier-over is seen, and X indicates that carrier-over is recognized. The first copy was subjected to the evaluation.

The above results are shown in Table 1.

TABLE 1

| | | Image Density | | Density Unevenness | | Brush Mark (number/5 mm) | | Carrier-over | |
|---|---|---|---|---|---|---|---|---|---|
| | Carrier | Low temperature/ low humidity | High temperature/ high humidity | Low temperature/ low humidity | High temperature/ high humidity | Low temperature/ low humidity | High temperature/ high humidity | Low temperature/ low humidity | High temperature/ high humidity |
| Example 1 | A | 0.50 | 0.53 | ○ | ○ | 0 | 0 | ○ | ○ |
| Example 2 | B | 0.51 | 0.53 | ○ | ○ | 0 | 0 | ○ | ○ |
| Example 3 | C | 0.52 | 0.53 | ○ | ○ | 0 | 0 | ○ | ○ |
| Example 4 | D | 0.51 | 0.53 | ○ | ○ | 0 | 0 | ○ | ○ |
| Example 5 | E | 0.52 | 0.60 | ○ | ○ | 0 | 0 | ○ | ○ |
| Comparative Example 1 | F | 0.42 | 0.45 | X | X | 0 | 0 | ○ | ○ |
| Comparative Example 2 | G | 0.43 | 0.46 | X | X | 8 | 12 | X | X |
| Comparative Example 3 | H | 0.52 | 0.82 | ○ | ○ | 0 | 0 | ○ | ○ |
| Example 8 | I | 0.51 | 0.58 | ○ | ○ | 0 | 0 | ○ | ○ |

As can be seen from this Table, when the carriers of the present invention, particularly the carriers A, B, C and D were used, excellent image quality could be obtained, and they were stable against the environmental changes. With respect to carrier E, since the added amount of the conductive powder was relatively large, the charging quantity decreased at high temperature and high humidity, and the image density was somewhat high. Furthermore, in carrier I, since the core material surface of the conductive powder was coated with oxygen deficit type tin oxide, the charging quantity decreased at high temperature and high humidity, and the image density was somewhat high.

On the other hand, when a core having low resistance was uniformly coated with a resin having high resistance, as in carrier F of the Comparative Example, brush marks and carrier-over were not seen, but density unevenness was seen in the central portion and peripheral portion of the solid image, and the image density was low. It is considered that this is because the electric resistance of the resin coating layer is too high to keep the electric resistance of the carrier higher within a predetermined value, hence IMB type characteristics appear. When a resin coating layer having low resistance was formed on the core having high resistance, as in carrier G of the Comparative Example, brush marks and carrier-over occurred, the image density was low and density unevenness was seen. When a resin coating layer having medium resistance was formed on the core having low resistance, as in carrier H of the Comparative Example, since the spherical conductive powder was used in a large quantity, brush marks, carrier-over and density unevenness were not seen, but the image density became high at high temperature and high humidity.

As can be understood from the above results, color images having high quality can be stably obtained without image defects, by uniformly forming a resin coating layer with medium resistance containing acicular or fibrous conductive powder on a core having low resistance and controlling the electric resistance of the carrier within a desired range.

Preparation of the Developer Used in Examples 7 to 12 and Comparative Examples 4 to 5

100 parts by weight of the above-mentioned carrier A~I (except carrier G) were mixed with 5 parts by weight of Magenta toner for A-Color 635 produced by Fuji Xerox Co. to prepare developers for Examples 7 to 12 and Comparative Examples 4 to 5.

Developing Device and Evaluation Test

The above developers were put in the image forming apparatus 10 shown in FIG. 2, and the evaluation environment was adjusted to low temperature and low humidity (10° C., 15%) and high temperature and high humidity (28° C., 85%), respectively, to evaluate the saturation area, image density, brush marks and carrier-over.

Brush Marks and Carrier-Over

The evaluation was done in the same manner as in Examples 1 to 6, and Comparative Examples 1 to 3.

Incidentally, the developing bias potential in the evaluation of the image density, brush marks and carrier-over was applied to the magnetic roll 62 so that the developing toner quantity showed the saturation characteristic with respect to the developer having a saturation area. Specifically, the direct-current superposed alternating-current bias potential having the DC component of −500 V and the AC component (voltage between peaks) of 100 V (6 kHz) was used.

The above results are shown in Table 2.

TABLE 2

| | | Image Density | | Saturation Area | | Brush Marks (number/5 mm) | | Carrier-over | |
|---|---|---|---|---|---|---|---|---|---|
| | Carrier | Low temperature/ low humidity | High temperature/ high humidity | Low temperature/ low humidity | High temperature/ high humidity | Low temperature/ low humidity | High temperature/ high humidity | Low temperature/ low humidity | High temperature/ high humidity |
| Example 7 | A | 1.80 | 1.83 | ○ | ○ | 0 | 0 | ○ | ○ |
| Example 8 | B | 1.81 | 1.83 | ○ | ○ | 0 | 0 | ○ | ○ |
| Example 9 | C | 1.82 | 1.83 | ○ | ○ | 0 | 0 | ○ | ○ |
| Example 10 | D | 1.81 | 1.83 | ○ | ○ | 0 | 0 | ○ | ○ |
| Example 11 | E | 1.78 | 1.90 | ○ | ○ | 0 | 0 | ○ | ○ |
| Comparative Example 4 | F | 1.62 | 1.65 | X | X | 0 | 0 | ○ | ○ |
| Comparative Example 5 | H | 1.62 | 2.01 | ○ | ○ | 0 | 0 | ○ | ○ |
| Example 12 | I | 1.79 | 1.88 | ○ | ○ | 0 | 0 | ○ | ○ |

Incidentally, the actual developing condition and the evaluation method are as follows.

Developing Conditions

Type of photosensitive material 16: OPC (84 mmØ)

Process speed: 160 mm/s

Initial charging potential: −650 V

Exposed portion Potential: −200 V

ROS: LED (400 dpi)

Outer diameter of magnetic roll 62: 30 mmØ

Peak value of the magnetic flux density in the radial direction of magnetic roll 62: 100 mT Rotation speed of magnetic roll 62: 336 mm/s Interval (DRS) between photosensitive material 16 and developer carrier 60 when developing section 56 faces photosensitive material 16: 0.5 mm Saturation Area The developing bias potential was sequentially changed, and ○ indicates that a saturation area was seen in the development curve expressed by the contrast potential and the developing toner quantity, and X indicates that a saturation area was not seen therein.

Image Density

A solid image (20 mm×20 mm) having the original density of 1.80 was reproduced, the relative reflection density of the output image with respect to the white paper was measured by a Macbeth densitometer. It was judged that the closer the image density was to 1.80, the better it was. The first copy was subjected to the evaluation.

As can be understood from this Table, when the carriers of the present invention, particularly the carriers A, B, C and H were used, the saturation area could be seen, brush marks and carrier-over were not seen and the image density was stable against the environmental changes. With respect to carrier E, since the added amount of the conductive powder was relatively large, the charging quantity decreased at high temperature and high humidity, and the image density was somewhat high. Furthermore, in carrier I, since the core material surface of the conductive powder was coated with oxygen deficit type tin oxide, the charging quantity decreased at high temperature and high humidity, and the image density was somewhat high. On the other hand, when the core having low resistance was uniformly coated with a resin having high resistance, as in carrier F of the Comparative Example, brush marks and carrier-over were not seen, but the saturation area could not be seen, the density unevenness was seen in the central portion and peripheral portion of the solid image, and the image density was low. It is considered that this is because the electric resistance of the resin coating layer is too high, keeping the electric resistance of the carrier higher than the predetermined value, hence IBM type characteristics appear. When a resin coating layer having medium resistance was formed on a core having low resistance, as in carrier H of the Comparative Example, the saturation area could be obtained, and brush marks and carrier-over were not seen, but since the spherical conductive powder was used in a large quantity, the image density became high at high temperature and high humidity.

Example 14

100 parts by weight of the above-mentioned carrier A was mixed with 5 parts by weight of Yellow toner, Magenta toner and Cyan toner for A-Color 635 produced by Fuji Xerox Co., respectively, to prepare developers for the respective colors, and they were put into each developing section 56 of the image forming apparatus 10 shown in FIG. 2. In addition, as the photosensitive material 16, a photosensitive material having a light damping curve as shown in FIG. 8B and having a sensitivity unevenness in the peripheral direction (photosensitive material A) was used, and an image corresponding to a substantially flesh tint (the input image area: 50%) was output. In addition, as the photosensitive material 16, a photosensitive material having a light damping curve as shown in FIG. 8A and having a sensitivity unevenness in the axial direction of the rotation (photosensitive material B) was used, and an image corresponding to a substantially flesh tint (the input image area: 50%) was output. At this time, the direct-current superposed alternating-current bias potential having the DC component of -500 V and the AC component (voltage between peaks) of 100 V (6 kHz) was applied to the magnetic roll 62, so that the developing toner quantity developed on the latent image showed the saturation characteristic.

Comparative Example 6

100 parts by weight of the above-mentioned carrier F was mixed with 5 parts by weight of Yellow toner, Magenta toner and Cyan toner for A-Color 635 produced by Fuji Xerox Co., respectively, to prepare developers for the respective colors, and the test was conducted as in the above Example.

Incidentally, in Example 13 and Comparative Example 6, the latent image contrast potential at the time of exposure with the input image area factor of 50%, was 90% or higher of the latent image contrast potential formed by the charging potential of the photosensitive material and the surface potential at the time of exposure with the input image area factor of 100%.

The difference in color in the image surface on the recording material corresponding to the whole surface of the image forming area of the photosensitive material was determined by visual inspection. The evaluation result is shown by ○ when there is no difference in color in the same surface, and X when there is difference in color in the same surface. The result is shown in Table 3.

TABLE 3

| | Carrier | Photosensitive material A | Photosensitive material B | Notes |
|---|---|---|---|---|
| Example 13 | A | ○ | ○ | Saturation phenomenon |
| Comparative Example 6 | F | ○ | X | Non-saturation phenomenon |

In the case of a developer containing the carrier F of the Comparative Example, that is, a developer which could not obtain the saturation area, the difference in color in the image surface due to the sensitivity unevenness of the photosensitive material could be seen clearly. But in the case of a developer containing the carrier A of the Example, that is, a developer which could obtain the saturation area, it was found that the difference in color in the image surface due to the sensitivity unevenness of the photosensitive material was not seen, and the developer showed stable gradation against the change of the potential of the latent image.

What is claimed is:

1. A carrier for an electrostatic latent image developer for electrophotography, having a resin coating layer containing a conductive powder on a core material, wherein the aspect ratio of said conductive powder is not less than 3, the dynamic electric resistance of said core material in a magnetic brush state under an electric field of $10^4$ V/cm is lower than 1 Ω.cm, and the electric resistance of said resin coating layer is within a range of from 10 to $1\times10^8$ Ω.cm.

2. A carrier for an electrostatic latent image developer according to claim 1, wherein said conductive powder is contained in an amount of from 2 to 20% by volume with respect to the resin coating layer.

3. A carrier for an electrostatic latent image developer according to claim 1, wherein the film thickness of the resin coating layer is from 0.3 to 5 μm.

4. A carrier for an electrostatic latent image developer according to claim 1, wherein the average carrier particle diameter is in a range of from 10 to 100 μm.

5. A carrier for an electrostatic latent image developer according to claim 1, wherein the core material is ferrite.

6. A carrier for an electrostatic latent image developer according to claim 5, wherein the electric resistance of the carrier is in a range of from 10 to $1\times10^9$ Ω.cm.

7. A carrier for an electrostatic latent image developer according to claim 1, wherein the electric resistance of said conductive powder is not higher than $1\times10^6$ Ω.cm.

8. A carrier for an electrostatic latent image developer according to claim 7, wherein the conductive powder is one of a conductive metal oxide or a powder coated with a conductive metal oxide.

9. A carrier for an electrostatic latent image developer according to claim 1, wherein the conductive powder is one of a conductive metal oxide or a powder coated with a conductive metal oxide.

10. An electrostatic latent image developer comprising:

toner particles comprising a binder resin and a coloring agent, and a carrier having a core material and a resin coating layer provided on the core material, wherein the resin coating layer of the carrier (i) contains a conductive powder having an aspect ratio of not less than 3, and (ii) has an electrical resistance in a range of from 10 to $1\times10^8$ Ω.cm, the core material of the carrier has a dynamic electric resistance of less than 1 Ω.cm under an electric field of $10^4$ V/cm in a magnetic brush state.

11. An electrostatic latent image developer according to claim 10, wherein the electric resistance of said conductive powder is not higher than $1\times10^6$ Ω.cm.

12. An electrostatic latent image developer according to claim 11, wherein the conductive powder is one of a conductive metal oxide or a powder coated with a conductive metal oxide.

13. An electrostatic latent image developer according to claim 10, wherein the conductive powder is one of a conductive metal oxide or a powder coated with a conductive metal oxide.

14. An image forming method comprising the steps of:

forming a latent image on a latent image carrying member, developing said latent image by using a developer, transferring the developed toner image to an image receiving member, and thermally fixing the toner image on the image receiving member, wherein said method uses an electrostatic latent image developer comprising:

toner particles comprising a binder resin and a coloring agent, and a carrier having a resin coating layer provided on the core material, said resin coating layer (i) containing a conductive powder which has an aspect ratio of not less than 3, and (ii) having an electric resistance in a range of from 10 to $1\times10^8$ Ω.cm, said core material having a dynamic electric resistance of less than 1 Ω.cm under an electric field of $10^4$ V/cm in a magnetic brush state.

15. An image forming method according to claim 14, wherein the developing process uses an electrostatic latent image developer whose development curve, expressed by a contrast potential defined by the development bias potential and the potential of the exposed portion of the latent image carrying member, as well as the quantity of the developing toner transferring to the latent image on the latent image carrying member has a saturation area, and the developing bias is applied to the developer carrying member so that the quantity of the developing toner shows the saturation characteristic.

16. An image forming method according to claim 14, wherein the developing bias potential is a developing bias potential in which the alternating-current electric field, having a voltage between peaks of from 100 to 500 V and a frequency of from 400 Hz to 20 kHz, is superposed on the direct-current electric field.

17. An image forming method according to claim 14, wherein the electric resistance of said conductive powder is not higher than $1\times10^6$ Ω.cm.

18. An image forming method according to claim 17, wherein the conductive powder is one of a conductive metal oxide or a powder coated with a conductive metal oxide.

19. An image forming method according to claim 14, wherein the conductive powder is one of a conductive metal oxide or a powder coated with a conductive metal oxide.

* * * * *